US009912091B1

(12) United States Patent
Miyazawa

(10) Patent No.: US 9,912,091 B1
(45) Date of Patent: Mar. 6, 2018

(54) TERMINAL MODULE

(71) Applicant: Sumitomo Wiring Systems, Ltd., Yokkaichi, Mie (JP)

(72) Inventor: Kiyohito Miyazawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/678,168

(22) Filed: Aug. 16, 2017

(30) Foreign Application Priority Data

Sep. 6, 2016 (JP) ..... 2016-173620

(51) Int. Cl.
*H01R 13/422* (2006.01)
*H01R 11/12* (2006.01)
*H01R 13/621* (2006.01)

(52) U.S. Cl.
CPC ..... *H01R 13/422* (2013.01); *H01R 11/12* (2013.01); *H01R 13/6215* (2013.01)

(58) Field of Classification Search
CPC ..... H01R 13/422; H01R 11/12; H01R 4/34; H01R 13/434; H01R 13/639; H01R 13/6215
USPC ..... 439/744, 364, 784, 805, 871
See application file for complete search history.

(56) References Cited

U.S. PATENT DOCUMENTS 5,997,341 A * 12/1999 Ushiyama ..... H01R 4/305 439/480
6,053,780 A * 4/2000 Ono ..... H01R 4/34 439/810
7,611,360 B2 * 11/2009 Akahori ..... H01R 4/185 439/76.2
7,914,300 B2 * 3/2011 Akahori ..... B60R 16/0238 439/76.2
8,105,121 B2 * 1/2012 Miyamoto ..... H01R 4/646 439/883
8,647,152 B2 * 2/2014 Sugiyama ..... H01R 13/41 439/625
8,747,139 B2 * 6/2014 Amano ..... H01R 11/12 439/287
9,083,095 B2 * 7/2015 Takase ..... H01M 2/1077
9,306,299 B2 * 4/2016 Yoshida ..... H01R 11/12
(Continued)

FOREIGN PATENT DOCUMENTS

JP 2009-301874 12/2009

*Primary Examiner* — Tulsidas C Patel
*Assistant Examiner* — Travis Chambers
(74) *Attorney, Agent, or Firm* — Gerald E. Hespos; Michael J. Porco; Matthew T. Hespos

(57) ABSTRACT

A terminal module A includes a plurality of terminal fittings (30) each including a horizontal plate-like connecting portion (31) and a wire connecting portion (35) extending rearward from the plate-like connecting portion (31), a locking wall (38) rising from a front end edge of the plate-like connecting portion (31) and including a locking hole (42), and an insulating case (10) including accommodating portions (11) configured to individually accommodate the plurality of terminal fittings (30). Each accommodating portion (11) includes a receiving portion (23) configured such that a wire connecting portion (35) is to be placed thereon, a front panel (13) facing the locking wall (38), a locking projection (16) formed on the front panel (13) so that a locking hole (42) is to be locked thereto, and a support (22) facing the plate-like connecting portion (31) from behind.

10 Claims, 9 Drawing Sheets

(56) References Cited

U.S. PATENT DOCUMENTS

| | | | | |
|---|---|---|---|---|
| 9,318,819 | B2 * | 4/2016 | Backstrom | H01R 4/56 |
| 9,466,908 | B2 * | 10/2016 | Ohkubo | H01R 13/111 |
| 9,490,598 | B2 * | 11/2016 | Onoda | H01R 4/48 |
| 9,520,656 | B2 * | 12/2016 | Kakimi | H01R 4/30 |
| 9,692,148 | B2 * | 6/2017 | Uehara | H01R 4/185 |
| 2011/0092111 | A1 | 4/2011 | Tsuchiya et al. | |
| 2014/0333462 | A1 * | 11/2014 | Breems | H03M 3/412 341/143 |
| 2016/0301149 | A1 * | 10/2016 | Konig | H01R 4/183 |
| 2017/0229796 | A1 * | 8/2017 | Kitagawa | H01R 4/64 |

* cited by examiner

TERMINAL MODULE

BACKGROUND

Field of the Invention

The invention relates to a terminal module.

Japanese Unexamined Patent Publication No. 2009-301874 discloses a structure in which an insulator is placed on a lid body of a battery case constituting a battery module. Metal terminals are mounted on the upper surface of the insulator and adjacent metal terminals are coupled by busbars using bolts and nuts. The metal terminals are components constituting electrodes of secondary batteries. Thus, the electrodes of adjacent secondary batteries are connected by the busbars. A voltage of the secondary battery can be detected if a terminal fitting connected to a voltage detection circuit is connected to the metal terminal together with the busbar by a bolt.

Plural busbars are mounted one by one on the metal terminals in the above-described battery module. Thus, plural terminal fittings are mounted one by one on the metal terminals when mounting the terminal fittings for voltage detection. Individually handling the terminal fittings this way is inefficient, and an improvement is desired.

The invention was completed based on the above situation and aims to enable plural terminal fittings to be handled collectively.

SUMMARY

The invention is directed to a terminal module with plural terminal fittings. Each terminal fitting includes a horizontal plate-like connecting portion formed with a mounting hole through which a bolt of a fastening member is to be inserted. A wire connecting portion extends rearward from an outer periphery of the plate-like connecting portion. A locking wall rises from a front edge of the plate-like connecting portion and includes a locking hole. An insulating case includes accommodating portions configured for individually accommodating the terminal fittings with both upper and lower surfaces of the plate-like connecting portions open outward. Each accommodating portion includes a receiving portion that is configured so that the wire connecting portion is to be placed thereon. The accommodating portion has a front wall that faces a front surface of the locking wall and a locking projection is formed on the front wall so that the locking hole is to be locked thereto. The accommodating portion further has a support facing the plate-like connecting portion from behind.

The terminal fitting accommodated in the accommodating portion is positioned in a front-rear direction by causing the locking wall and the plate-like connecting portion to face the front wall and the supporting portion. The terminal fitting also is positioned in a vertical direction by locking the locking hole to the locking projection and placing the wire connecting portion on the receiving portion. The plural terminal fittings are positioned and mounted into the insulating case in this way so that the plural terminal fittings can be collectively handled.

A front rotation stop may be formed on the front wall and may be configured to restrict lateral displacement by locking the locking wall. According to this configuration, the terminal fitting can be prevented from being dragged to rotate when a bolt inserted through the mounting hole is fastened or when a nut screwed onto the bolt inserted through the mounting hole is fastened.

A rear rotation stop may be formed on the plate-like connecting portion and may be configured to restrict a lateral relative displacement by locking the support. According to this configuration, the terminal fitting is prevented from being dragged to rotate when a bolt inserted through the mounting hole is fastened or when a nut screwed onto the bolt inserted through the mounting hole is fastened.

A resilient retaining piece may be formed in the accommodating portion and may face an outer peripheral edge of the plate-like connecting portion from above. According to this configuration, the terminal fitting is prevented from being lifted from the insulating case.

A guide may project at a position of the front wall above the locking projection and may be configured to avoid interference of a lower end edge of the locking wall with the locking projection by causing an upper end edge of the locking wall to slide down in contact therewith. According to this configuration, the lower end edge of the locking wall is not hooked to the locking projection when the locking wall is accommodated into the accommodating portion along the front wall. Thus, the locking hole can be locked to the locking projection without any problem.

An upper end edge of the locking wall may be folded into two. According to this configuration, the strength of the upper end edge of the locking wall is enhanced.

DETAILED DESCRIPTION

Figure 1:
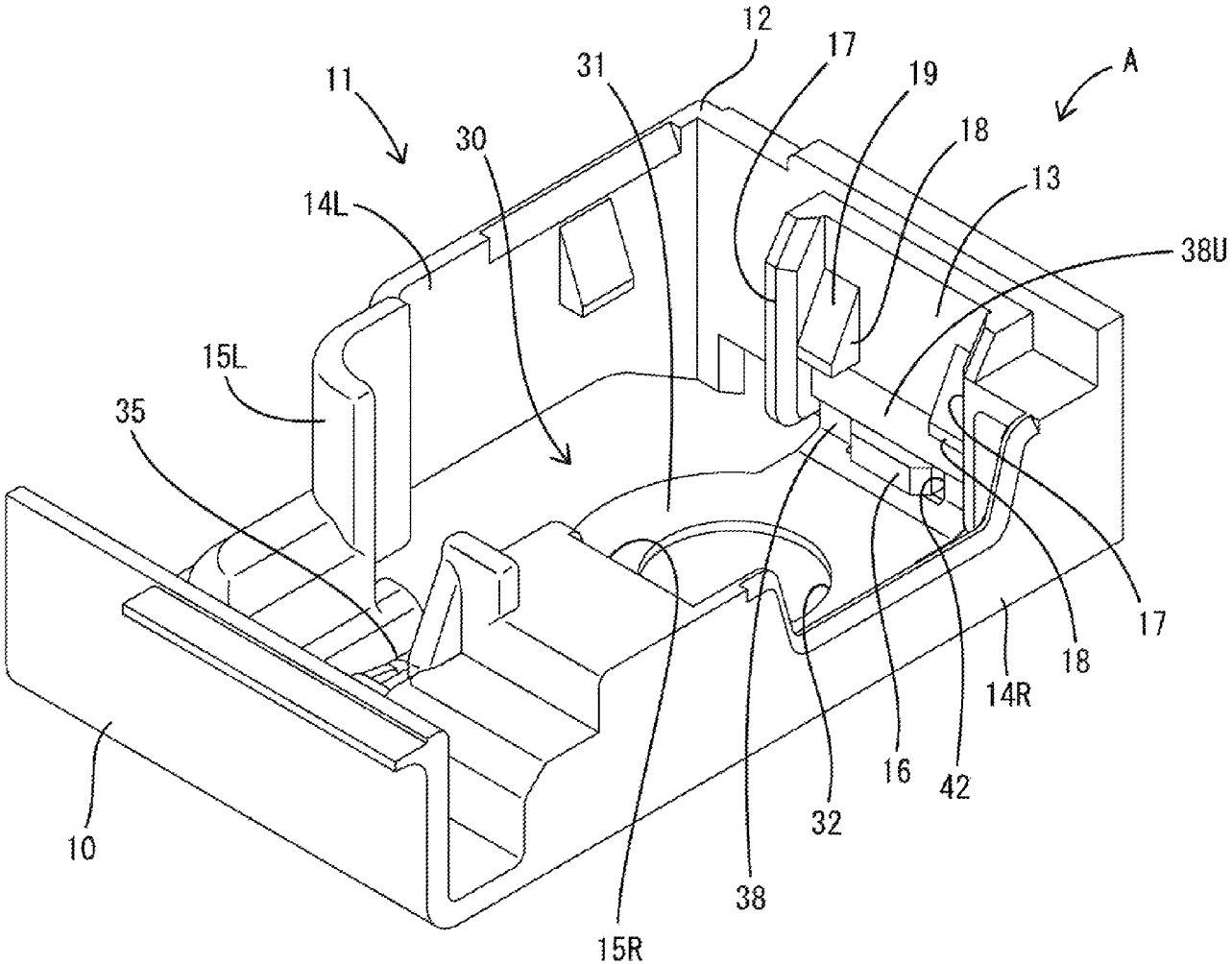
FIG. 1 is a perspective view of a terminal module of one embodiment.
Figure 2:
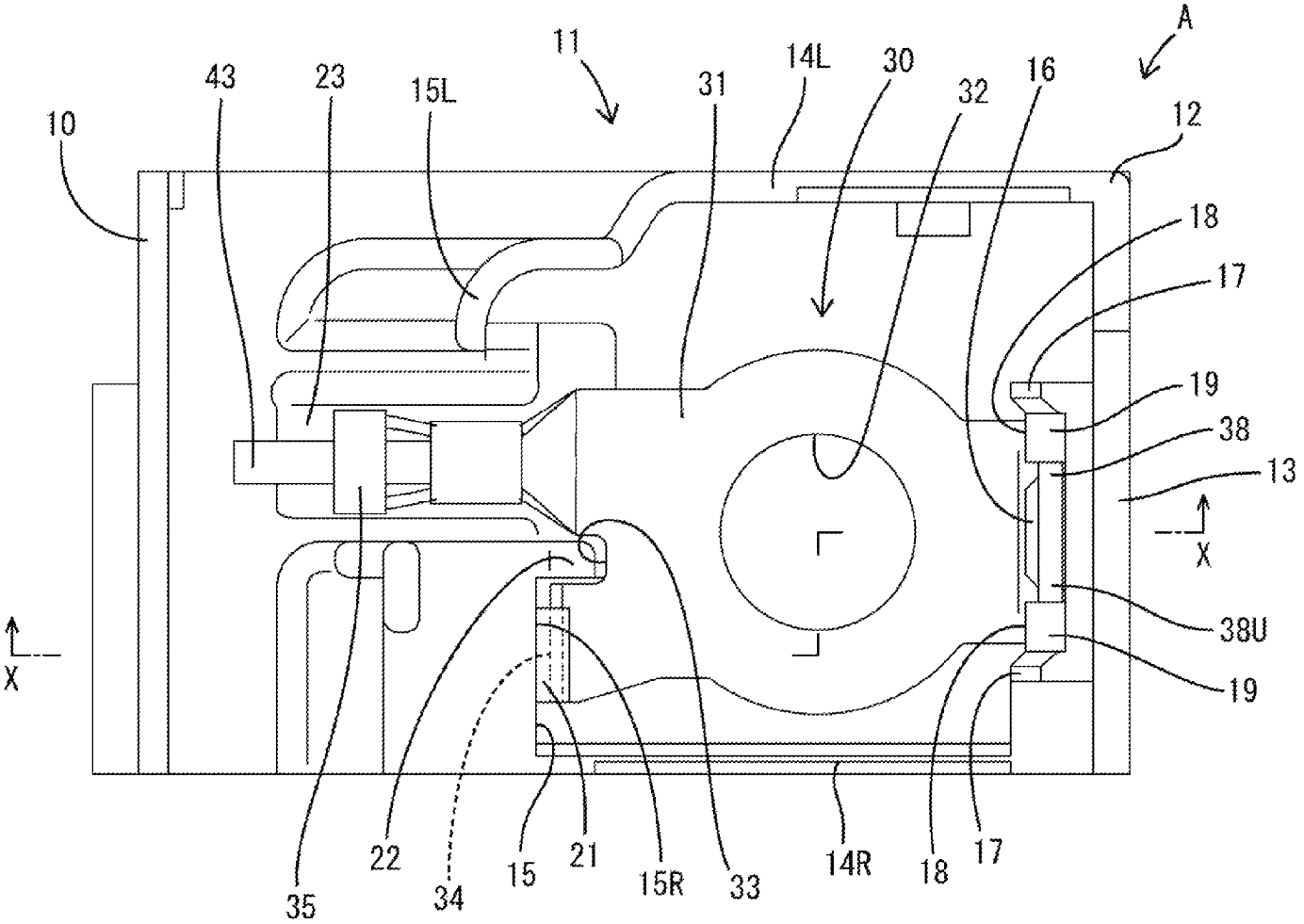
FIG. 2 is a plan view of the terminal module.
Figure 8:
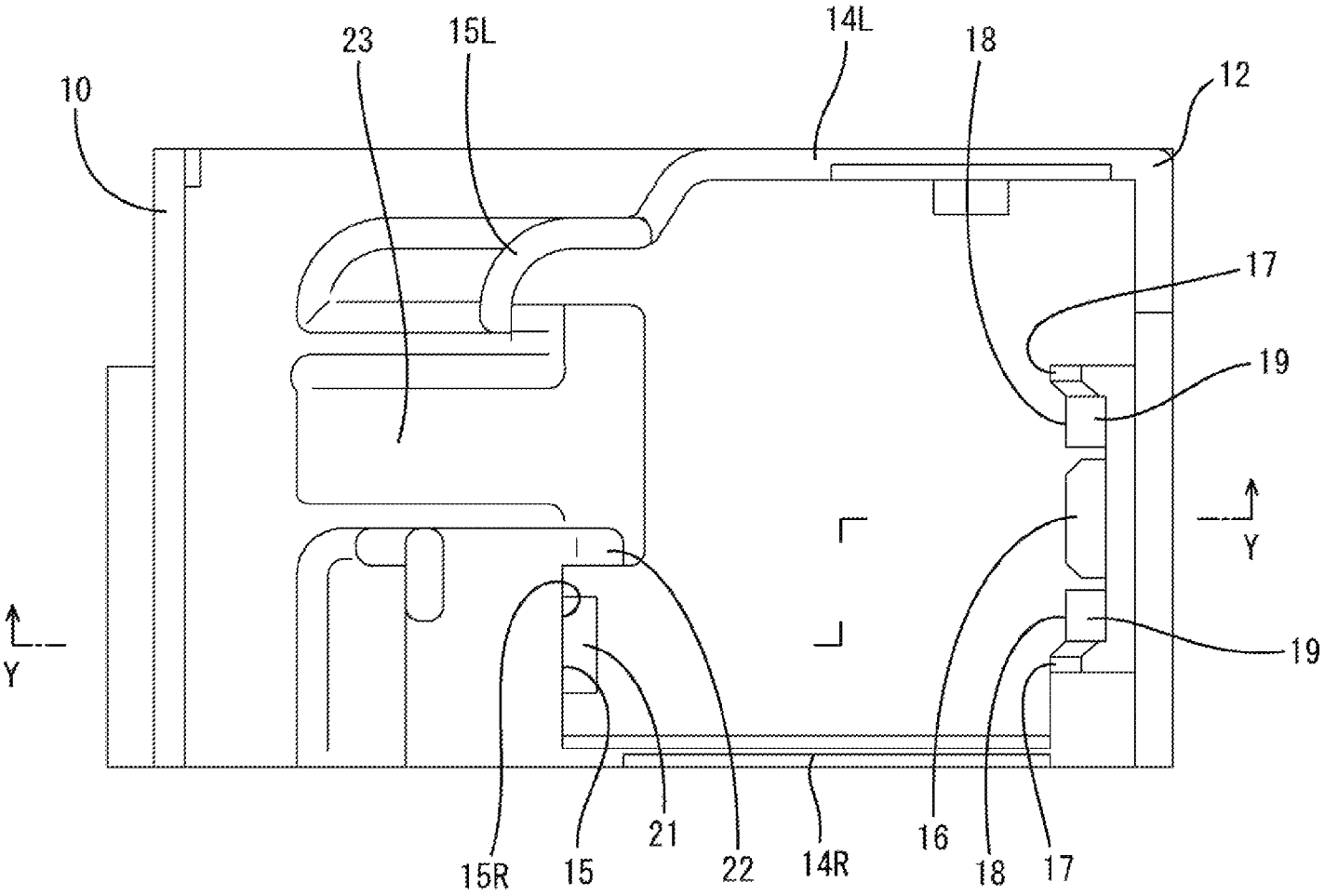
FIG. 8 is a plan view of the insulating case.
Figure 9:
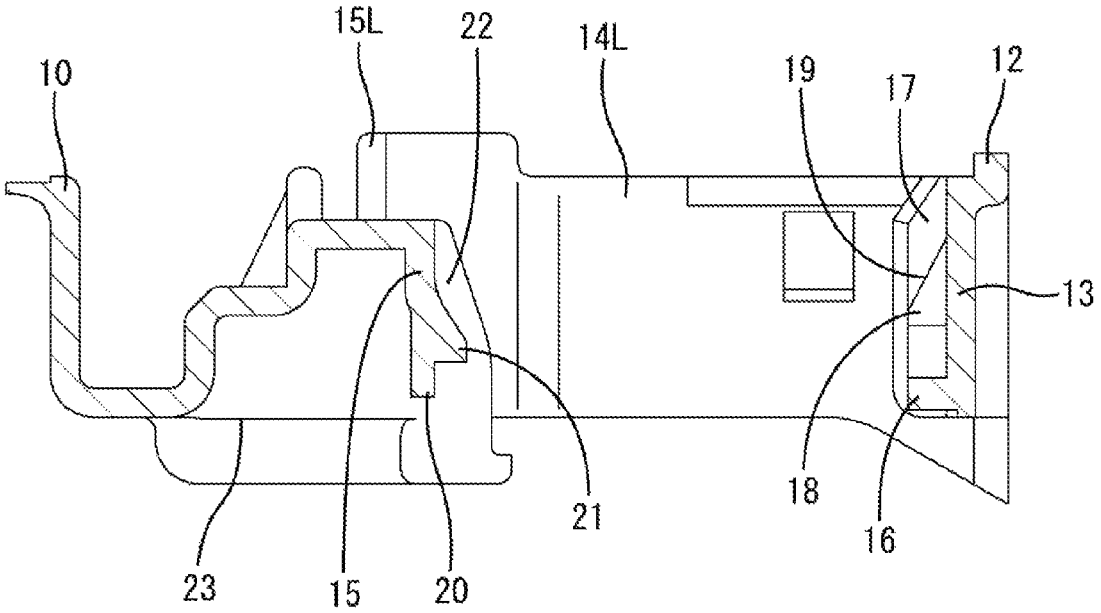
FIG. 9 is a section along Y-Y of FIG. 8.
Figure 10:
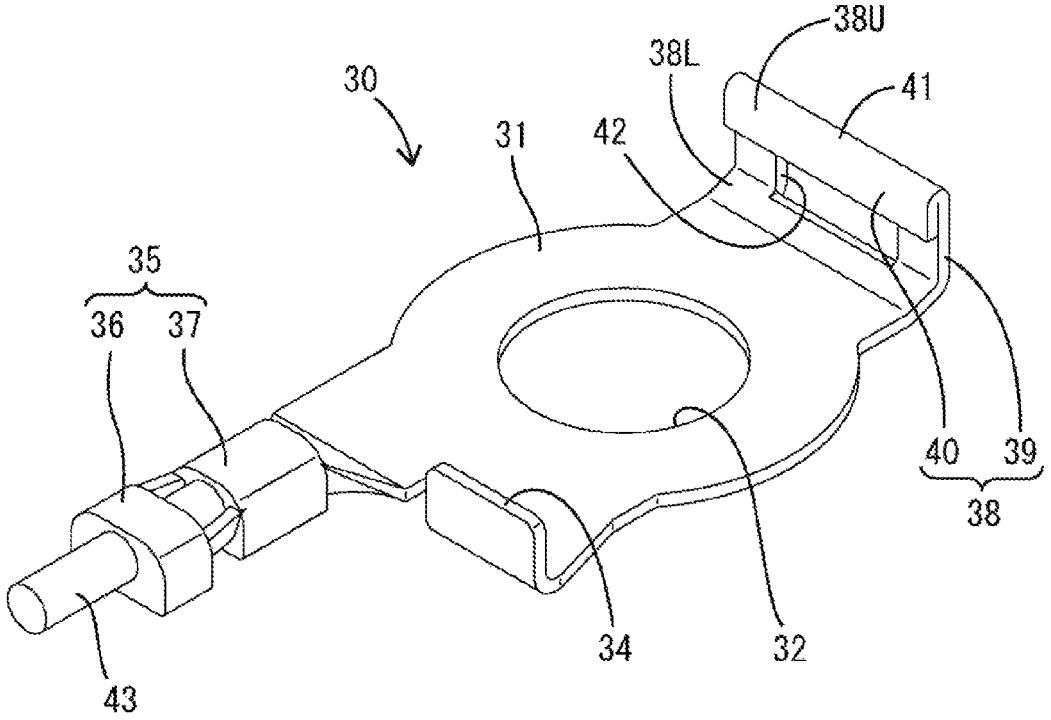
FIG. 10 is a perspective view of the terminal fitting.
Figure 11:
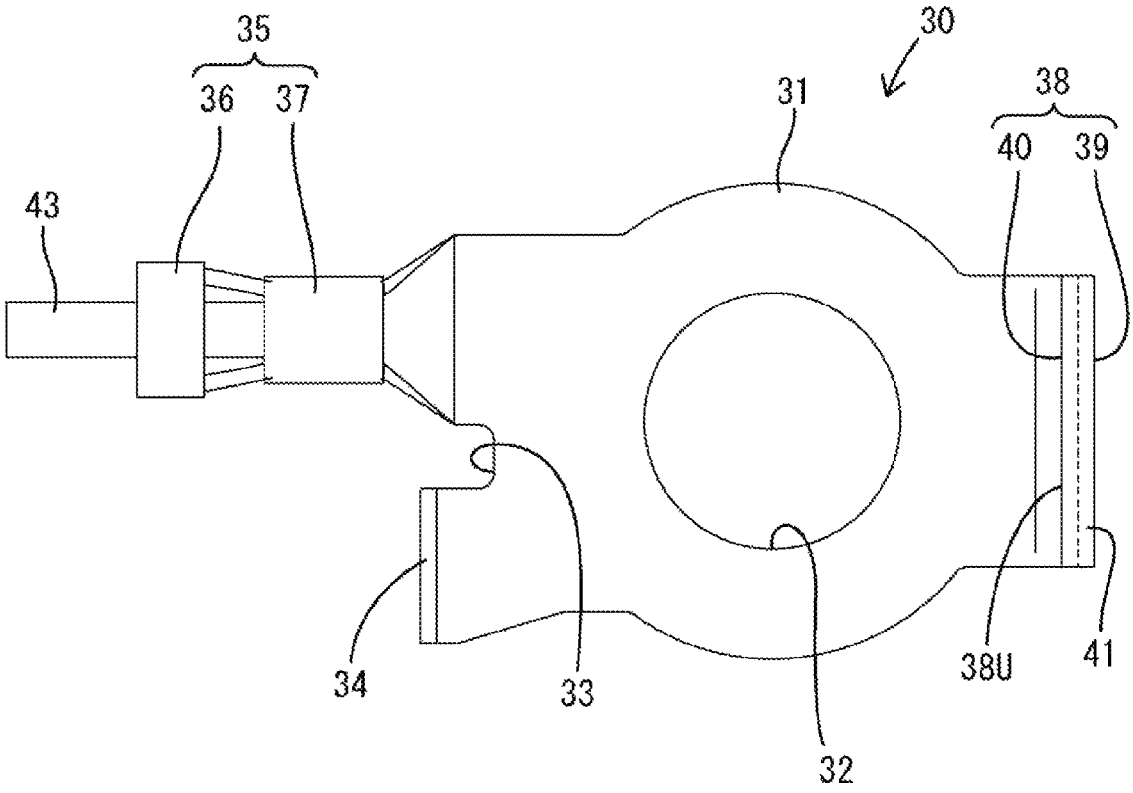
FIG. 11 is a plan view of the terminal fitting.

An embodiment of the invention is described with reference to FIGS. 1 to 11. Note that, in the following description, an oblique right-upper side in FIGS. 1, 7 and 10 and a right side in FIGS. 2 to 6, 8, 9 and 11 are defined as a front concerning a front-rear direction. Concerning a vertical direction, upper and lower sides in FIGS. 1, 4 to 7, 9 and 10 are defined as upper and lower sides. Concerning a lateral direction, a lower side in FIGS. 2, 8 and 11 is defined as a right side.

A terminal module A of this embodiment is an integrated assembly of one insulating case 10 made of synthetic resin and a plurality of terminal fittings 30. The terminal fittings 30 are connected conductively to electrodes 50 provided on the upper surfaces o secondary batteries (not shown) of a battery module using fastening members 51. Each fastening member 51 has a bolt 52 projecting up from the electrode 50 and a nut 53 to be screwed onto the bolt 52 from above. A wire 43 is fixed to each terminal fitting 30 and can be connected to a detection circuit (not shown) for detecting a voltage of the secondary battery.

<Insulating Case 10>

The insulating case 10 is formed with accommodating portions 11 connected side by side in the lateral direction. For the sake of convenience, only one accommodating portion 11 is shown in FIGS. 1 to 9. The upper surface of the accommodating portion 11 is open upward over substantially over the entire area thereof, and the lower surface of the accommodating portion 11 is open downward in a wide area excluding a receiving portion 23 thereof. One terminal fitting 30 is accommodated into each accommodating portion 11 by being dropped down from above. The accommodating portion 11 includes a frame-shaped peripheral wall 12 with a front panel 13, a right side panel 14R, a left side panel 14L and a rear panel 15.

A locking projection 16 in the form of a laterally long projecting rib is formed on the rear surface of the front panel 13 (inner surface of the peripheral wall 12). Similarly, left and right guide ribs 17 (front rotation stopping portion as claimed) are formed on the rear surface of the front panel 13 and are bilaterally symmetrically arranged across the locking projection 16. The guide ribs 17 extend vertically and parallel to a mounting direction of the terminal fitting 30 into the accommodating portion 11. A formation range of each guide rib 17 is continuous from the lower end to the upper end of the front panel 13.

Bilaterally symmetrical left and right guide projections 18 are arranged along the inner surfaces of the guide ribs 17 and are formed on the rear surface of the front wall 13. Each guide projection 18 has a guide slope 19 inclined down toward the rear. The left and right guide projections 18 are arranged above the locking projection 16 in the vertical direction and are at opposite lateral sides of the locking projection 16 in a plan view.

The rear panel 15 is composed of a right wall portion 15R extending from the right end of the accommodating portion 11 (peripheral wall 12) to a position slightly to the right of a lateral center and an arcuate wall portion 15L arranged on a left end part of the accommodating portion 11. A part of the right wall portion 15R defines a resilient retaining piece 20 cantilevered down from the upper end of the right panel 15R (see FIGS. 3 and 4) and is resiliently deflectable in the front-rear direction. A retaining projection 21 is formed on the front surface of the resilient retaining piece 20 (inner surface of the peripheral wall 12).

The accommodating portion 11 is formed with a support 22 in the form of a rib projecting forward from a left end part of the right wall 15R. The support 22 is formed continuously from the upper end to the lower end of the right wall 15R, and an upper half area of the front end edge of the support 22 is inclined down toward the front. The accommodating portion 11 is formed with the receiving portion 23 in the form of a horizontal plate. The receiving portion 23 is arranged in an area behind the rear panel 15 in the front-rear direction and is arranged between the right wall portion 15R and the arcuate wall portion 15L in the lateral direction.

<Terminal Fitting 30>

The terminal fitting 30 is formed by applying bending and the like to a metal plate material stamped into a predetermined shape. For the sake of convenience, only one terminal fitting 30 is shown in FIGS. 1 to 6, 10 and 11. The terminal fitting 30 is formed integrally with a horizontal plate-like connecting portion 31, a wire connecting portion 35 and a locking wall 38. A substantially circular mounting hole 32 penetrates through a central part of the plate-like connecting portion 31 in a plate thickness direction is formed in. The mounting hole 32 is disposed substantially in a central part of the plate-like connecting portion 31 both in the lateral direction and in the front-rear direction.

A locking recess 33 (rear rotation stopping portion as claimed) is formed on the rear end edge of the plate-like connecting portion 31. The locking recess 33 is formed by cutting a laterally central part of the rear end edge of the plate-like connecting portion 31 forwardly. In the lateral direction, the entire area of the locking recess 33 is disposed within the range of an opening area of the mounting hole 32. A retaining wall 34 is formed in an area of the rear end edge of the plate-like connecting portion 31 to the right of the locking recess 33 and rises at a substantially right angle. In the lateral direction, a left end part of the retaining wall 34 is arranged within the range of the opening area of the mounting hole 32.

The wire connecting portion 35 is cantilevered rearward from an area of the rear edge of the plate-like connecting portion 31 to the left of the locking recess 33 and includes an open insulation barrel 36 and an open wire barrel portion 37. The insulation barrel 36 is crimped to a front part of an insulation coating of the wire 43, and the wire barrel 37 is crimped to a front part of the wire 43 where a conductor is exposed. In the lateral direction, a right area of the wire connecting portion 35 is arranged within the range of the opening area of the mounting hole 32.

The locking wall 38 is cantilevered up from a laterally central part of the front end of the plate-like connecting portion 31. The locking wall 38 includes a substantially rectangular base plate 39 directly connected to the front end of the plate-like connecting portion 31 and a substantially rectangular folded portion 40 folded to turn toward a rear from the entire area of the upper end of the base plate 39 and extending down. A vertical dimension of the folded portion 40 is smaller than that of the base plate 39 and the lower edge of the folded portion 40 is above that of the base plate 39 (locking wall 38). In this way, an upper end 38U of the locking wall 38 has a double wall structure. The outer surface (upper surface) of the upper end 38U of the locking wall 38 is formed into an arcuate surface 41 having a substantially semicircular cross-section.

A wide rectangular locking hole 42 penetrates from the front surface to the rear surface of the base plate 39 of the locking wall 38. The locking hole 42 is disposed below the upper end 38U of the double wall structure and is formed only in the base plate 39. The upper edge of an opening area of the locking hole 42 is at the same height as the lower end edge of the folded portion 40. A vertical dimension between the upper end of the locking wall 38 and the upper edge of the opening area of the locking hole 42 is slightly smaller than a vertical distance between the upper surface of the locking projection 16 and the lower surface of the guide projection 18. Further, in the lateral direction, a formation area of the locking wall 38 is substantially equal to the opening area of the mounting hole 32. The locking wall 38 is at a position opposite to the locking recess 33 and the retaining wall 34 across the mounting hole 32.

Functions and Effects of Embodiment

In mounting the terminal fitting 30 into the accommodating portion 11, the terminal fitting 30 is inclined so that a front end of the plate-like connecting portion 31 faces obliquely down and the plate-like connecting portion 31 is accommodated into a space enclosed by the peripheral wall 12. At this time, the locking wall 38 is fit between the left and right guide ribs 17 and the plate-like connecting portion 31 is displaced down while the upper end 38U of the locking wall 38 slides in contact with the rear surface of the front wall 13. After the upper end 38U of the locking wall 38 reaches the upper end of the guide projection 18, the upper end 38U (arcuate surface 41) of the locking wall 38 slides down in contact with the guide slope 19 of the guide projection 18 as shown by an imaginary line in FIG. 5.

A lower end 38L of the locking wall 38 is below the upper end 38U and the locking projection 16 projects rearward from the front wall 13. Thus, the lower end 38L of the locking wall 38 may interfere with the locking projection 16 in the process of displacing the locking wall 38 down. However, the locking wall 38 is guided toward an oblique lower side with respect to the front wall 13 by the inclination of the guide slope 19, i.e. guided in a direction rearward of and away from the locking projection 16 in the front-rear direction. Thus, the lower end 38L of the locking wall 38 does not interfere with the locking projection 16.

Figure 5:
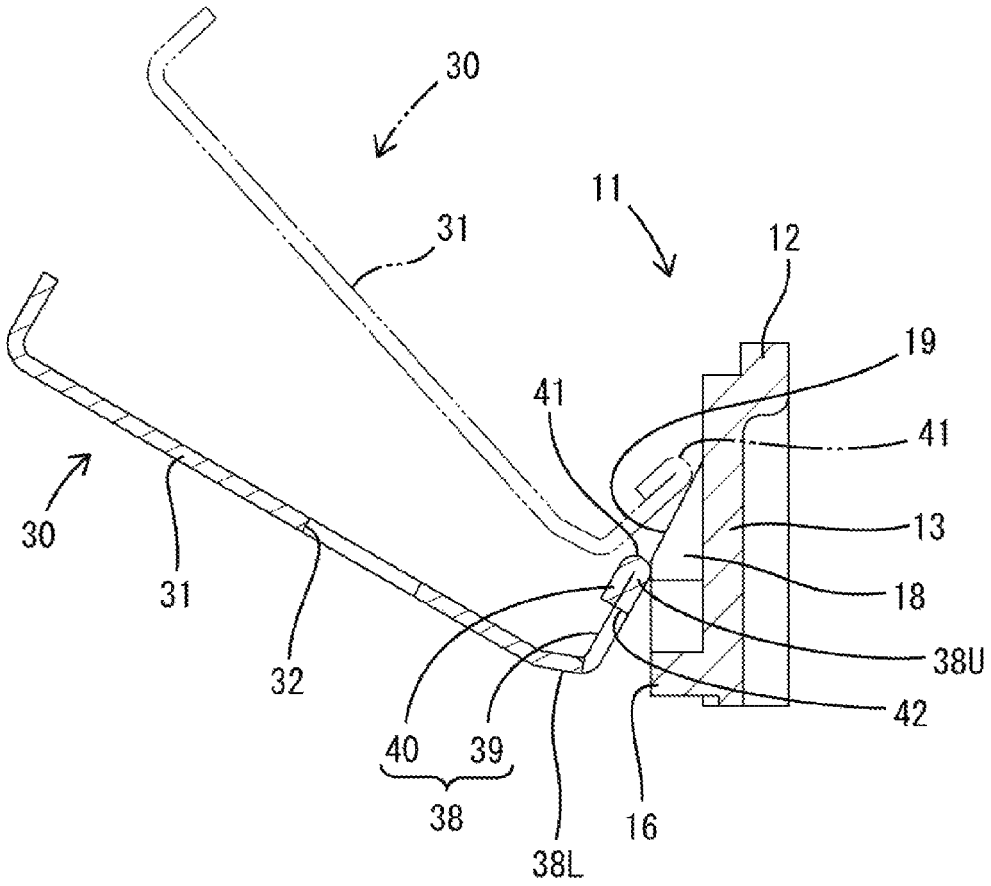
FIG. 5 is a partial section showing a state where an upper end edge portion of a locking wall portion slides in contact with a guide projection in the process of mounting a terminal fitting into an insulating case.
Figure 6:
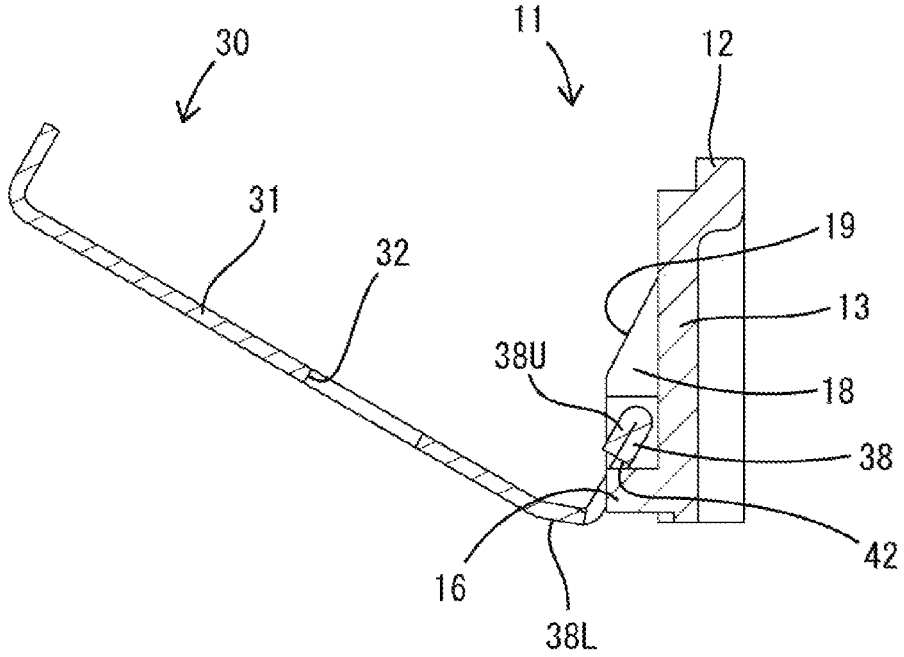
FIG. 6 is a partial section showing a state where a locking hole of the terminal fitting is locked to a locking projection of the insulating case in the process of mounting the terminal fitting into the insulating case.
Figure 7:
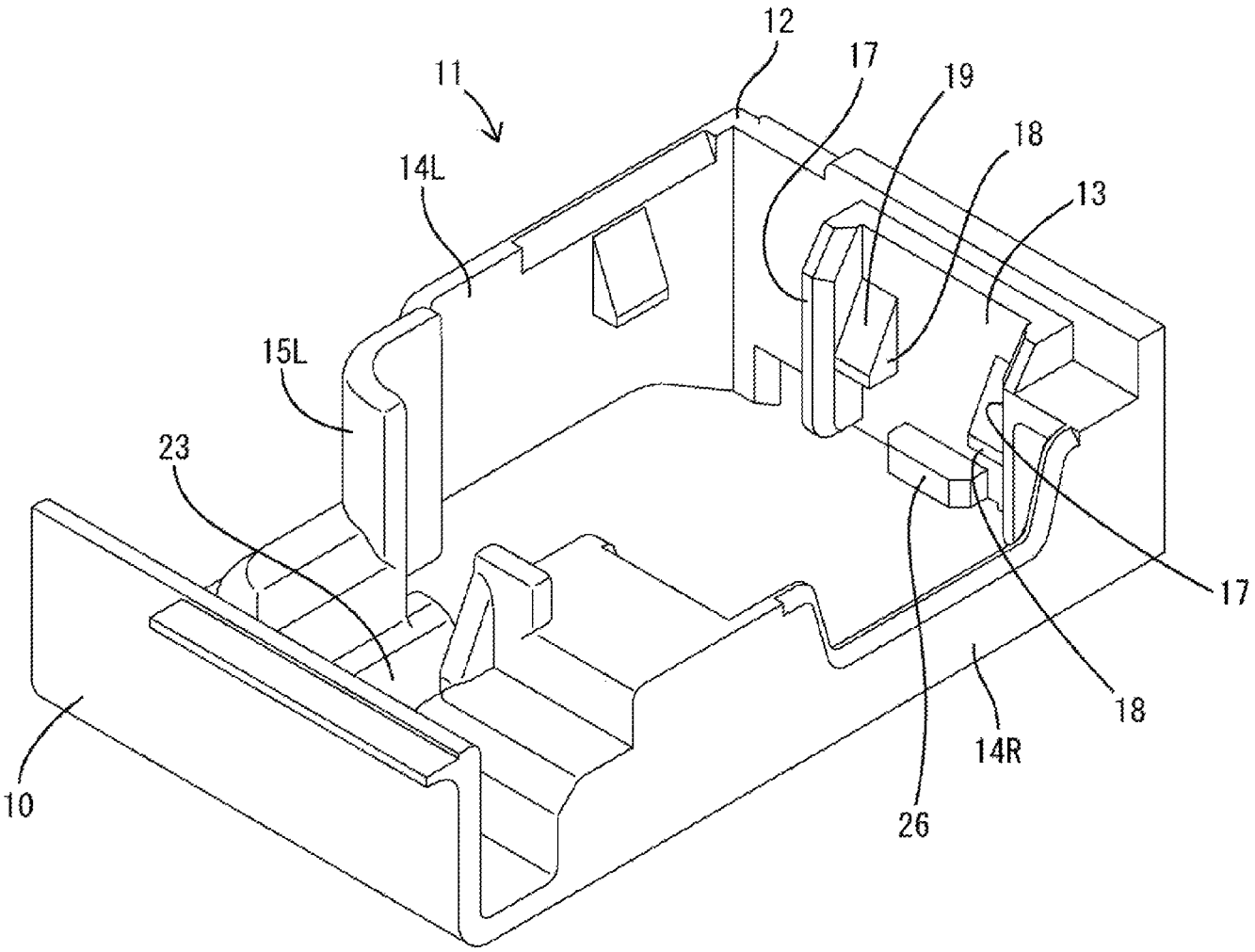
FIG. 7 is a perspective view of the insulating case.

When the upper end 38U of the locking wall 38 reaches the lower end of the guide slope 19, as shown by a solid line in FIG. 5, in the process of accommodating the plate-like connecting portion 31 into the accommodating portion 11, the lower end 38L of the locking wall 38 is located below the upper end of the locking projection 16. A vertical dimension from the upper end of the locking hole 42 to the upper end of the locking wall 38 is slightly smaller than a vertical distance between the locking projection 16 and the guide projection 18. Thus, even if the upper end edge portion 38U of the locking wall 38 is separated down from the lower end of the guide slope 19 and the entire locking wall 38 is displaced obliquely to a lower-front side, the lower end 38L of the locking wall 38 does not interfere with the locking projection 16 and a tip part (rear end part) of the locking projection 16 is fit shallowly into the locking hole 42, as shown in FIG. 6. During this time, the terminal fitting 30 is in such an inclined posture that the front part of the plate-like connecting portion 31 is facing obliquely down.

Figure 3:
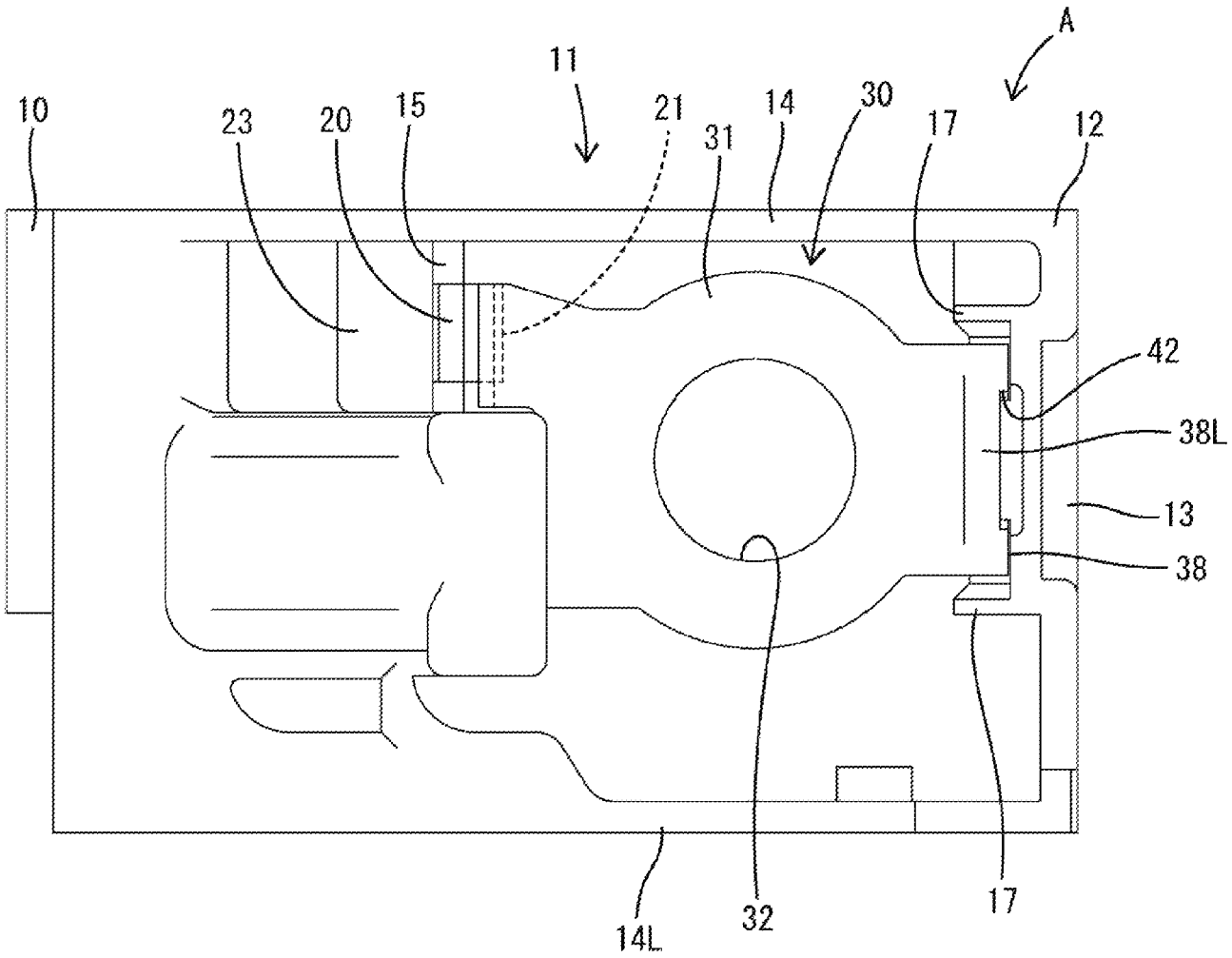
FIG. 3 is a bottom view of the terminal module.
Figure 4:
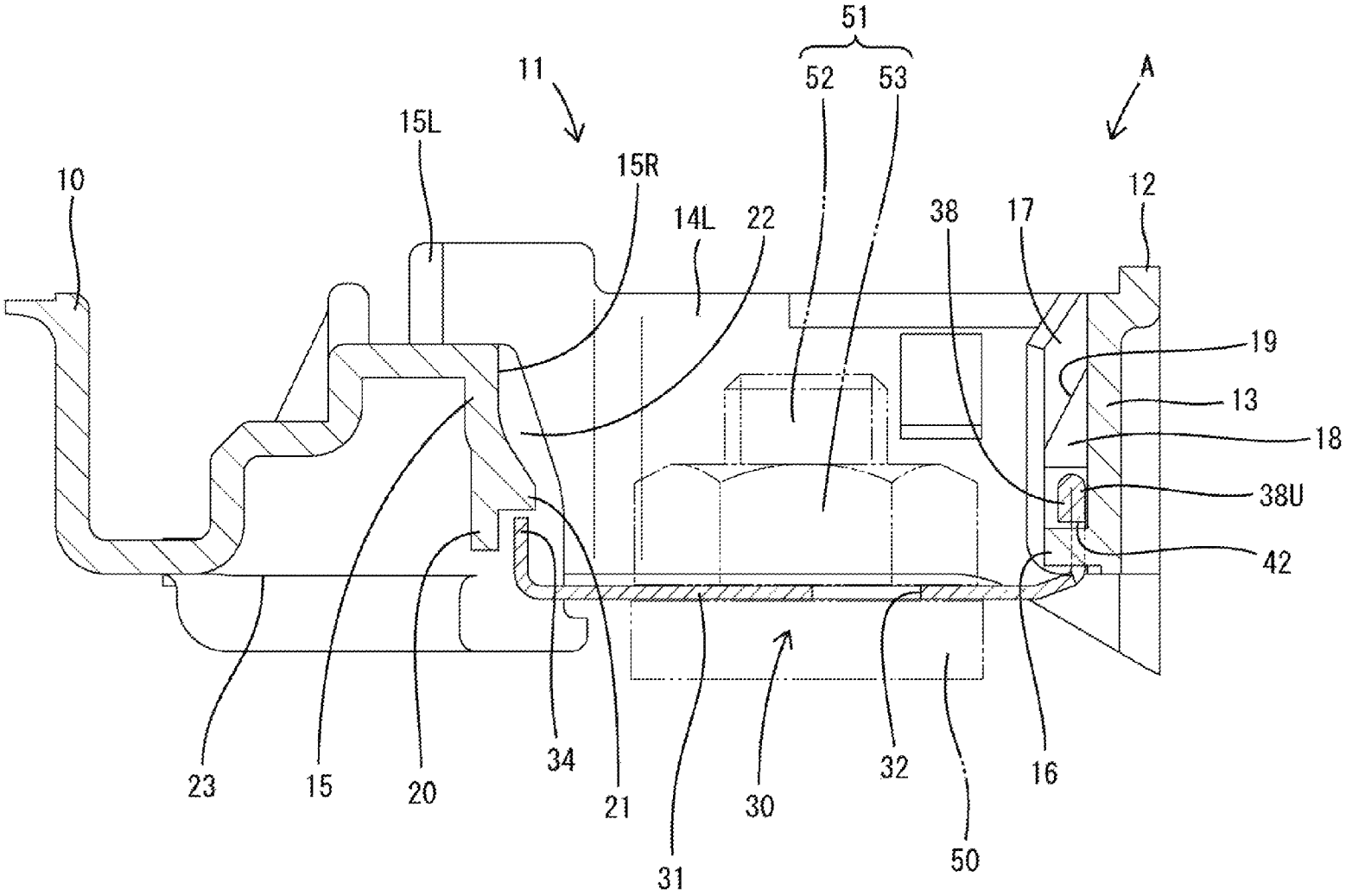
FIG. 4 is a section along X-X of FIG. 2.

The locking projection 16 is fit deeply into the locking hole 42 when the upper end 38U of the locking wall 38 is brought into contact with the front panel 13 from a state shown in FIG. 6, and when the terminal fitting 30 is returned to a horizontal posture with the contact part serving as a support, as shown in FIG. 4. Thus, the locking wall 38 is fit between the left and right guide ribs 17 and the wire connecting portion 35 is inserted between the right wall portion 15R and the arcuate wall portion 15L and placed on the receiving portion 23, as shown in FIG. 3. Additionally, the locking recess 33 is fit to the support 22, as shown in FIG. 2. Further, in the process of returning the terminal fitting 30 to the horizontal posture, the retaining wall 34 of the terminal fitting 30 interferes with the retaining projection 21 to resiliently displace the resilient retaining piece 20 rearward. When the terminal fitting 30 returns to the horizontal posture, the upper end of the retaining wall 34 passes over the retaining projection 21 so that the resilient retaining piece 20 resiliently returns forward and the retaining projection 21 becomes lockable to the upper end of the retaining wall 34 from above.

The front surface of the locking wall 38 and the rear surface of the front panel 13 face each other and a back end part of the locking recess 33 and the front end of the support 22 face each other to position the terminal fitting 30 in the front-rear direction with respect to the accommodating portion 11. Fitting the locking projection 16 in the locking hole 42 and fitting the locking wall portion 38 and the guide ribs 17 positions the front end part of the terminal fitting 30 in the lateral direction with respect to the accommodating portion 11. Fitting the locking recess 33 and the support 22 positions a rear end part of the plate-like connecting portion 31 in the lateral direction with respect to the accommodating portion 11. The terminal fitting 30 is positioned in the vertical direction with respect to the accommodating portion 11 by: fitting the locking projection 16 and the locking hole 42; sandwiching the upper end 38U of the locking wall 38 between the locking projection 16 and the guide projection 18; placing the wire connecting portion 35 on the receiving portion 23; and causing the upper end of the retaining wall 34 and the retaining projection 21 of the resilient retaining piece 20 to face each other.

In the above way, each terminal fitting 30 is positioned individually and mounted into each accommodating portion 11 of the insulating case 10. With the terminal fitting 30 mounted, at least the mounting hole 32 and a part around the mounting hole 32 in the lower surface of the plate-like connecting portion 31 are open downward of the accommodating portion 11, as shown in FIG. 3. In this way, it is possible to arrange the terminal module A above the battery module, place the plate-like connecting portions 31 on the upper surfaces of the electrodes 50 and insert the bolts 52 of the electrodes 50 into the mounting holes 32.

Further, since the entire area of the plate-like connecting portion 31 is open upward of the accommodating portion 11, as shown in FIG. 2, the nut 53 can be screwed from above onto the bolt 52 projecting up from the mounting hole 32. The screwed nut 53 is accommodated in the space enclosed by the peripheral wall 12 and contacts the upper surface of the plate-like connecting portion 31. When the nut 53 is tightened from this state, the plate-like connecting portion 31 is sandwiched strongly between the electrode 50 and the nut 53 and the electrode 50 and the terminal fitting 30 are connected conductively.

In fastening the nut 53, the terminal fitting 30 may be dragged to rotate together with the nut 53 due to friction between a seat surface of the nut 53 and the upper surface of the plate-like connecting portion 31. However, a lateral displacement of the terminal fitting 30 with respect to the accommodating portion 11 is restricted by fitting the locking projection 16 and the locking hole 42, fitting the locking wall 38 and the guide ribs 17 and fitting the locking recess 33 and the support 22. Therefore the terminal fitting 30 is not dragged to rotate. Further, the drag rotation in the case of loosening the nut 53 also is prevented by these engagements.

As described above, the terminal module A includes the plural terminal fittings 30 and the insulating case 10. Each terminal fitting 30 includes the horizontal plate-like connecting portion 31, the wire connecting portion 35 and the locking wall 38. The plate-like connecting portion 31 is formed with the mounting hole 32 through which the bolt 52 of the fastening member 51 is to be inserted. The wire connecting portion 35 extends rearward from the outer periphery of the plate-like connecting portion 31. The locking wall 38 rises from the front end of the plate-like connecting portion 31 and includes the locking hole 42.

The insulating case 10 includes the accommodating portions 11 for individually accommodating the terminal fittings 30 with both upper and lower surfaces of the plate-like connecting portion 31 open out. The accommodating portion 11 includes the receiving portion 23 on which the wire connecting portion 35 is to be placed, the front panel 13 facing the front of the locking wall 38, the locking projection 16 on the front panel 13 so that the locking hole 42 is to be locked thereto, and the support 22 facing the plate-like connecting portion 31 from behind.

According to this configuration, the terminal fitting 30 accommodated in the accommodating portion 11 is positioned in the front-rear direction by causing the locking wall 38 and the plate-like connecting portion 31 to face the front wall 13 and the supporting portion 22, and positioned in the vertical direction by locking the locking hole 42 to the locking projection 16 and placing the wire connecting portion 35 on the receiving portion 23. The terminal fittings 30 can be handled collectively since the plural terminal fittings 30 are mounted in the insulating case 10 in the terminal module A.

The front wall 13 has the guide ribs 17 for restricting lateral relative displacement by locking the locking wall 38. Accordingly, when the nut 53 screwed onto the bolt 52 inserted through the mounting hole 32 is fastened, the terminal fitting 30 can be prevented from being dragged to rotate. Further, the plate-like connecting portion 31 may include the locking recess 33 for restricting a lateral relative displacement by locking the supporting portion 22. Also by this configuration, the terminal fitting 30 can be prevented from being dragged to rotate when the nut 53 screwed onto the bolt 52 inserted through the mounting hole 32 is fastened.

Further, the accommodating portion 11 is formed with the resilient retaining piece 20 facing an outer peripheral edge part of the plate-like connecting portion 31 from above. Thus, the terminal fitting 30 mounted into the accommodating portion 11 can be prevented from being lifted with respect to the insulating case 10. Further, the guide projection 18 for avoiding the interference of the lower end edge portion 38L of the locking wall 38 with the locking projection 16 by causing the upper end edge portion 38U of the locking wall 38 to slide down in contact therewith is formed at the position of the front panel 13 above the locking projection 16. According to this configuration, since the lower end portion 38L of the locking wall 38 is not hooked to the locking projection 16 in accommodating the locking wall 38 into the accommodating portion 11 along the front panel 13, the locking hole 42 can be locked to the locking projection 16 without any problem. Further, since the upper end 38U of the locking wall 38 is folded into two, the strength of the upper end edge portion 38U of the locking wall 38 is high.

The invention is not limited to the above described and illustrated embodiment. For example, the following embodiments are also included in the scope of the invention.

Although the front panel is formed with the front rotation stopping portion in the above embodiment, the front panel may not include the front rotation stopping portion.

Although the plate-like connecting portion is formed with the rear rotation stopping portion in the above embodiment, the plate-like connecting portion may not include the rear rotation stopping portion.

Although the resilient retaining piece is formed on the rear panel of the accommodating portion in the above embodiment, the resilient retaining piece may be formed on the front panel or side panel of the accommodating portion.

Although the front panel is formed with the guide projection in the above embodiment, the front panel may not include the guide projection.

Although the upper end edge of the locking wall is folded into two in the above embodiment, the upper end edge of the locking wall portion may be in the form of a single plate.

Although the bolt projecting from the electrode is inserted through the mounting hole in the above embodiment, the bolt may be inserted through the mounting hole from above the terminal fitting.

LIST OF REFERENCE SIGNS

A . . . terminal module
10 . . . insulating case
11 . . . accommodating portion
13 . . . front panel
16 . . . locking projection
17 . . . guide rib (front rotation stopping portion)
18 . . . guide projection
20 . . . resilient retaining piece
22 . . . support
23 . . . receiving portion
30 . . . terminal fitting
31 . . . plate-like connecting portion
32 . . . mounting hole
33 . . . locking recess (rear rotation stopping portion)
35 . . . wire connecting portion
38 . . . locking wall
38U . . . upper end edge portion of locking wall
38L . . . lower end edge portion of locking wall
42 . . . locking hole
51 . . . fastening member
52 . . . bolt

What is claimed is:

1. A terminal module, comprising:

at least one terminal fittings each including a horizontal plate-like connecting portion formed with a mounting hole through which a bolt of a fastening member is to be inserted, and a wire connecting portion extending rearward from an outer peripheral edge of the plate-like connecting portion;

a locking wall rising from a front end of the plate-like connecting portion and including a locking hole; and an insulating case including at least one accommodating portion configured to individually accommodate the plurality of terminal fittings with both upper and lower surfaces of the plate-like connecting portions open outward, the accommodating portion having:

a receiving portion configured such that the wire connecting portion is to be placed thereon;

a front panel facing a front surface of the locking wall;

a locking projection formed on the front panel such that the locking hole is to be locked thereto; and a support facing the plate-like connecting portion from behind.

2. The terminal module of claim 1, comprising a rear rotation stopping portion formed on the plate-like connecting portion and configured to restrict a lateral relative displacement by locking the support.

3. The terminal module of claim 1, comprising a resilient retaining piece formed in the accommodating portion and facing an outer peripheral edge of the plate-like connecting portion from above.

4. The terminal module of claim 1, comprising a guide projection formed at a position of the front panel above the locking projection and configured to avoid interference of a lower end edge of the locking wall with the locking projection by causing an upper end of the locking wall to slide down in contact therewith.

5. The terminal module of claim 1, wherein an upper end of the locking is folded into two.

6. The terminal module of claim 1, comprising a front rotation stopping portion formed on the front panel and configured to restrict a lateral relative displacement by locking the locking wall.

7. The terminal module of claim 6, comprising a rear rotation stopping portion formed on the plate-like connecting portion and configured to restrict a lateral relative displacement by locking the support.

8. The terminal module of claim 7, comprising a resilient retaining piece formed in the accommodating portion and facing an outer peripheral edge of the plate-like connecting portion from above.

9. The terminal module of claim 8, comprising a guide projection formed at a position of the front panel above the locking projection and configured to avoid interference of a lower end edge of the locking wall with the locking projection by causing an upper end of the locking wall to slide down in contact therewith.

10. The terminal module of claim 9, wherein the upper end of the locking is folded into two.

* * * * *